US009623539B2

(12) United States Patent
Robinson

(10) Patent No.: US 9,623,539 B2
(45) Date of Patent: Apr. 18, 2017

(54) CARVING CABINET HAVING PROTECTIVE CARVING BARRIER

(71) Applicant: Media Blast & Abrasive, Inc., Brea, CA (US)

(72) Inventor: Robert A. Robinson, Glenwood, NM (US)

(73) Assignee: Media Blast & Abrasive, Inc., Brea, CA (US)

( * ) Notice: Subject to any disclaimer, the term of this patent is extended or adjusted under 35 U.S.C. 154(b) by 177 days.

(21) Appl. No.: 14/324,389

(22) Filed: Jul. 7, 2014

(65) Prior Publication Data

US 2016/0001420 A1 Jan. 7, 2016

(51) Int. Cl.

| | |
|---|---|
| ***B24C 9/00*** | (2006.01) |
| ***B24C 1/04*** | (2006.01) |
| ***B24C 3/04*** | (2006.01) |

(52) U.S. Cl.

CPC ..... *B24C 9/00* (2013.01); *B24C 1/04* (2013.01); *B24C 3/04* (2013.01)

(58) Field of Classification Search

CPC .... B24C 1/04; B24C 3/02; B24C 3/04; B24C 5/02; B24C 9/00

USPC ..... 451/29, 38, 89, 90

See application file for complete search history.

(56) References Cited

U.S. PATENT DOCUMENTS

| | | | | |
|---|---|---|---|---|
| 722,464 A | | 3/1903 | Stevens | |
| 1,751,719 A | | 3/1930 | Uhri, Jr. | |
| 1,940,539 A | * | 12/1933 | Fritsche | B41C 3/00 15/302 |
| 2,299,405 A | * | 10/1942 | Prange | B24C 1/04 101/114 |
| 2,324,250 A | | 7/1943 | Voerge | |
| 2,376,287 A | | 5/1945 | Sorrentino | |
| 2,376,616 A | | 5/1945 | Oechsle et al. | |
| 2,387,193 A | | 10/1945 | Swenarton | |
| 2,440,643 A | | 4/1948 | Pettinos | |
| 2,450,401 A | * | 9/1948 | Thompson | B24C 1/04 451/29 |

(Continued)

OTHER PUBLICATIONS

Media Blast & Abrasives, Inc.; "High Quality Media Blast Cabinets"; 12 pages.

(Continued)

*Primary Examiner* — Eileen Morgan

(74) *Attorney, Agent, or Firm* — Stetina Brunda Garred & Brucker

(57) ABSTRACT

A carving cabinet configured to enable carving of the work-piece outside the main machine cabinet, without requiring the work-piece to be completely wrapped in a protective covering. The carving cabinet includes a housing defining an enclosure for operating the carving tool when carving the work-piece. A barrier member is coupled to the housing and is configured to substantially separate the work-piece from the enclosure when carving the work-piece. The barrier member includes a first surface facing toward the enclosure and an opposing second surface facing away from the enclosure. A carving port extends between the first surface and the second surface. The barrier member is configured to allow the work-piece to be disposable adjacent the second surface to enable carving of the work-piece through the carving port.

19 Claims, 5 Drawing Sheets

(56) References Cited

U.S. PATENT DOCUMENTS 2,462,480 A * 2/1949 Eppler ..... B24C 3/00 101/401.1
2,483,956 A * 10/1949 Workman ..... B24C 7/0053 451/89
2,587,184 A 2/1952 Marjama
2,669,809 A 2/1954 McGrath
2,717,476 A 9/1955 Myers
3,328,925 A * 7/1967 Hewitt ..... B24C 1/04 451/31
3,424,386 A 1/1969 Maasberg et al.
3,516,205 A 6/1970 Thomson
3,624,966 A * 12/1971 Palmer ..... B24C 3/06 101/114
D231,852 S 6/1974 Walsh
3,906,674 A * 9/1975 Stone ..... B24C 9/00 451/89
D239,155 S 3/1976 Kent et al.
3,953,184 A 4/1976 Storkford et al.
3,970,437 A 7/1976 Van Diepenbroek et al.
D241,756 S 10/1976 Gray
4,026,687 A 5/1977 Berz
4,047,907 A 9/1977 Knutsson et al.
4,048,918 A * 9/1977 Peck ..... B24C 1/04 101/114
D246,108 S 10/1977 Ashworth
4,099,937 A 7/1978 Ufken et al.
D250,196 S 11/1978 Caccioli et al.
4,140,502 A 2/1979 Margraf
4,144,043 A 3/1979 Johnston
4,156,600 A 5/1979 Jacobson
4,201,256 A 5/1980 Truhan
4,202,142 A 5/1980 Van Fossen
4,223,748 A 9/1980 Barendsen
4,230,468 A 10/1980 Rebours et al.
4,233,785 A 11/1980 Abell
D257,774 S 1/1981 Pierson
4,244,715 A 1/1981 Eisenbarth
4,253,610 A 3/1981 Larkin
4,266,673 A 5/1981 Haidlen et al.
4,272,260 A 6/1981 Klein et al.
4,275,531 A 6/1981 Van Fossen
4,281,485 A * 8/1981 Charity, III ..... B24C 3/06 451/29
4,285,707 A 8/1981 Pfenninger
4,286,974 A 9/1981 Schminke et al.
4,300,318 A 11/1981 Brown
4,330,400 A 5/1982 Schmidt
4,336,040 A 6/1982 Haberl
4,348,057 A 9/1982 Parenti et al.
4,360,990 A * 11/1982 Hubbard ..... B24C 3/04 451/2
4,416,673 A 11/1983 Kirchen et al.
D274,851 S 7/1984 Schmitz
4,543,111 A 9/1985 Miller et al.
4,585,466 A 4/1986 Syred et al.
4,655,806 A 4/1987 Bowersox
4,657,567 A 4/1987 Callgren et al.
4,673,424 A 6/1987 Range
4,689,923 A 9/1987 Goudeaux et al.
4,771,580 A 9/1988 Male
4,792,382 A 12/1988 Lorenz et al.
4,878,927 A 11/1989 Margraf
4,894,959 A 1/1990 Hoover
4,984,397 A 1/1991 Van Leeuwen
D323,661 S 2/1992 Zwicker
5,089,037 A 2/1992 Marsolais
5,185,968 A 2/1993 Lyras
5,221,300 A 6/1993 Hoogland et al.
5,271,751 A 12/1993 Lagler
D343,640 S 1/1994 Thies
D343,706 S 1/1994 Gurstein
D343,888 S 2/1994 Rupp
5,297,363 A 3/1994 Schroder et al.
5,312,040 A 5/1994 Woodward
5,319,894 A 6/1994 Shank, Jr.
D352,808 S 11/1994 McNeil
D354,799 S 1/1995 Self
D360,017 S 7/1995 Lopez
5,433,653 A 7/1995 Friess
D361,177 S 8/1995 Hoover
5,490,807 A * 2/1996 Marchell ..... B24C 9/00 451/29
5,512,005 A * 4/1996 Gulling ..... B24C 1/04 451/100
D370,490 S 6/1996 Zwicker
5,584,901 A 12/1996 Bakharev et al.
5,676,589 A 10/1997 Ashworth
5,690,709 A 11/1997 Barnes
5,716,260 A 2/1998 Griffin et al.
D394,526 S 5/1998 Strandell
5,761,764 A 6/1998 Fiegel et al.
5,800,246 A 9/1998 Tomioka
D400,212 S 10/1998 Brassil et al.
5,839,951 A 11/1998 Tomioka
5,975,996 A 11/1999 Settles
5,983,840 A 11/1999 Riccius et al.
6,051,054 A 4/2000 Ahman
6,195,837 B1 3/2001 Vanderlinden
6,224,645 B1 5/2001 Rydin et al.
6,251,051 B1 6/2001 Chen
6,254,362 B1 7/2001 Higuchi et al.
6,319,295 B1 11/2001 Tojner
6,346,035 B1 2/2002 Anderson et al.
6,431,965 B1 8/2002 Jones et al.
6,521,051 B1 2/2003 Lutich
D476,668 S 7/2003 Storer et al.
D482,827 S 11/2003 Storer et al.
D482,828 S 11/2003 Storer et al.
D489,794 S 5/2004 Storer et al.
6,833,016 B2 12/2004 Witter
7,008,304 B1 * 3/2006 Robinson ..... B04C 1/00 451/75
D534,557 S 1/2007 Storer et al.
2003/0124955 A1 * 7/2003 Hanson ..... B24C 3/04 451/2
2004/0092216 A1 5/2004 Publ et al.
2012/0077423 A1 * 3/2012 Pei ..... B24C 1/045 451/89

OTHER PUBLICATIONS

"Pipe Restoration—Air Filter"; 4 pages.
"Pipe Restoration—Revive Blaster #1"; 11 pages.
"Pipe Restoreation—Revive Blaster #2"; 7 pages.

* cited by examiner

CARVING CABINET HAVING PROTECTIVE CARVING BARRIER

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

Technical Field of the Invention

The present invention relates generally to a blast cabinet for carving a work-piece, and more specifically, to a blast cabinet specifically configured and adapted to allow an operator to hold the work-piece outside of a blasting enclosure with one hand and manipulate a carving nozzle located within the blasting enclosure with the other hand, which substantially eliminates the need to cover the work-piece in protective tape, thereby resulting in a quicker, more efficient carving process.

Description of the Related Art

Sandblast etching, carving, and engraving highly detailed designs in materials, such as glass, crystal, stone, and metals is well known in the art. To that end, blast cabinets have been used for designing surfaces on a work-piece by directing high pressure fluid containing abrasive blast media or blast particulate toward the work-piece. The abrasive blast particulate is typically a relatively hard material such as aluminum oxide and silicon carbide, although many other materials may be selected for use as the blast particulate.

Conventional sandcarving entails utilizing a photo-developed film to carve patterns on many different work-pieces formed of different materials and having a wide range of shapes. The work-piece is carved using a developed film, which is applied to the work-piece to only allow certain areas of the work-piece to be carved. The film is attached to the work-piece prior to carving and removed from the work-piece after carving.

A conventional blast cabinet typically includes a housing supported on legs. The housing defines a generally air tight enclosure having a pair of arm holes with gloves hermetically sealed thereto such that an operator may manipulate a blast hose and/or the work-piece for blasting thereof within the enclosure. The blast hose is configured to direct the high pressure fluid such as air carrying the blast particulate at high velocity toward the work-piece surfaces. The blast cabinet typically includes a transparent window to allow the operator to manipulate the work-piece and to visually observe the progress of the blasting.

During carving, the work-piece having the film attached thereto is placed within the enclosure and the high-pressure blasting media is directed toward the work-piece. The blast media bounces off of the work-piece and is generally violently thrown about within the enclosure along with surface coatings, dirt and scale that are abraded from the work-piece by the blast media. As such, any exposed surface of the work-piece may be scratched or scuffed by the moving blast particular, surface coatings, dirt and scale. Thus, to protect against such inadvertent scratching or scuffing, the work-piece is commonly wrapped with a protective covering, e.g., protective tape, prior to the carving step and removed after the carving step. Oftentimes, tape residue remains on the work-piece and must be removed from the work-piece prior to final shipment to the consumer. The process of applying the protective covering to the work-piece tends to be a very labor intensive, tedious and time consumer endeavor, which inflates the overall cost of the end product. Along these lines, the time attributable to applying and removing the protective tape can account for approximately 40% of the overall processing time.

Therefore, there exists a need in the art for an improved and more efficient blast cabinet design which allows a work-piece to be carved, sand blasted, etc., outside of the main cabinet to reduce or eliminate the added cost for protective part taping. Various aspects of the present invention address these particular needs, as will be discussed in more detail below.

BRIEF SUMMARY OF THE INVENTION

The present invention specifically addresses and alleviates the above-identified deficiencies in the art. Along these lines, there is provided a carving cabinet for carving a work-piece with a carving tool. The carving cabinet is specifically configured and adapted to enable carving of the work-piece outside of the main carving enclosure of the cabinet. This is possible using a sealed part-holding vestibule designed to allow the operator to hold the part outside the main carving enclosure of the cabinet while using the abrasive blasting nozzle located inside the main carving enclosure to direct abrasive toward the work-piece. The cabinet includes the sealed part-holding vestibule complete with an open area part processing port common with the inside cabinet chamber. A mold of the part may be held over the common port using strong magnets, which allows the part mold to have a processing port window that is common with the inside of the cabinet and enables the part to be sealed from the cabinet chamber. Placing the part into the part holding mold will substantially seal the common port allowing part processing using the mold window. In this respect, the part itself substantially seals the commonality between the vestibule and the blasting cabinet, thereby eliminating the time consuming part protection taping and tape removal, while keeping the part clean helping to further reduce the time required for cleaning a packing for shipment to the end user.

According to one embodiment, the carving cabinet includes a housing defining an enclosure for operating the carving tool when carving the work-piece. A barrier member is coupled to the housing and is configured to substantially separate the work-piece from the enclosure when carving the work-piece. The barrier member includes a first surface facing toward the enclosure and an opposing second surface facing away from the enclosure. A carving port extends between the first surface and the second surface. The barrier member is configured to allow the work-piece to be disposable adjacent the second surface to enable carving of the work-piece through the carving port.

The barrier member may be detachably coupled to the housing. The barrier member may be formed from a flexible material, such as a rubber material. The barrier member may be configured to be disposable in tension when the work-piece is disposed adjacent the second surface. The barrier member may be configured to form a seal with the work-piece when the work-piece is disposed adjacent the second surface of the barrier member.

According to another embodiment, the blasting cabinet includes a sealed part holding vestibule that is not considered part of the inside cabinet area by various air pollution control agencies. The configuration allows the work-piece to remain outside the blasting chamber to reduce time consuming protection taping.

A viewing window may be coupled to the housing to enable viewing into the enclosure. The viewing window may be offset to the vestibule side of the chamber to allow the operator to view see the part/work-piece held by the operator in the part-holding mold located at the end of the vestibule and within easy operator processing. The combination of the configuration of the vestibule, location of the offset window and the shape of the cabinet may allow the operator to use only one cabinet operator port for part processing.

A working port may be formed in the housing and configured enable a user to reach into the enclosure.

The sealed part-holding vestibule may be inside the main machine cabinet area and include a removable end plate. Several different end plates may be used, each of which are configured and adapted to for different uses. One particular configuration of the end plate may seal off the vestibule to allow the main cabinet to be used as a standard sandcarving machine, allowing the operator to place the part with protection taping inside the cabinet for sandcarving. A second end plate may include a window/port for part processing. The window may be supplied in different window sizes and locations to permit different part size processing. The window may be configured for part processing of flat parts using a compression seal on the end plate to substantially seal against the part being held against the window/port. It may be necessary to locate the window in another location to allow the part to enter the processing vestibule. A mold of the part may be used to cover and seal the processing window using strong magnets that may be cast into the mold to permit quick, tool-less mold changes. The mold may include a processing window/port for the part that allows only the film area to be common with the main blasting cabinet. The operator may place the part blindly into the mold located in the vestibule to allow sandcarving to occur. The new design allows for easy placement of the mold. Many parts that are to be carved are symmetrical, allowing the operator to lift and rotate the part to allow for 360 degree part processing with a small mold window opening. Another design of the removable plate may utilize a frame to hold a thin elastomeric diaphragm. The diaphragm may include a hole allowing the operator to push the part against the diaphragm, stretching the diaphragm and sealing a part with contour against the diaphragm. This allows sandcarving to occur without the need for casting a mold of the part.

The carving cabinet may additionally include a curtain coupled to the housing and at least partially extending over the barrier member.

The housing may include an attachment panel having an attachment panel opening formed therein and in communication with the enclosure. The carving cabinet may further include a mounting plate connectable to the attachment panel to at least partially extend over the attachment panel opening, with the barrier member being coupled to the mounting plate.

According to another embodiment, there is provided a method of carving a work-piece. The method includes providing a carving cabinet for carving a work-piece with a carving tool, wherein the carving cabinet includes a housing defining an enclosure for operating the carving tool when carving the work-piece, and a barrier member coupled to the housing and configured to substantially separate the work-piece from the enclosure when carving the work-piece. The barrier member further includes a first surface facing toward the enclosure, an opposing second surface facing away from the enclosure, and a carving port extending between the first surface and the second surface. The method further includes placing the work-piece adjacent the second surface and directing carving media from the carving tool to the work-piece through the carving port.

The present invention is best understood by reference to the following detailed description when read in conjunction with the accompanying drawings.

BRIEF DESCRIPTION OF THE DRAWINGS

These as well as other features of the present invention will become more apparent upon reference to the drawings wherein.

Common reference numerals are used throughout the drawings and a detailed description to indicate like elements.

DETAILED DESCRIPTION OF THE INVENTION

Figure 1A:
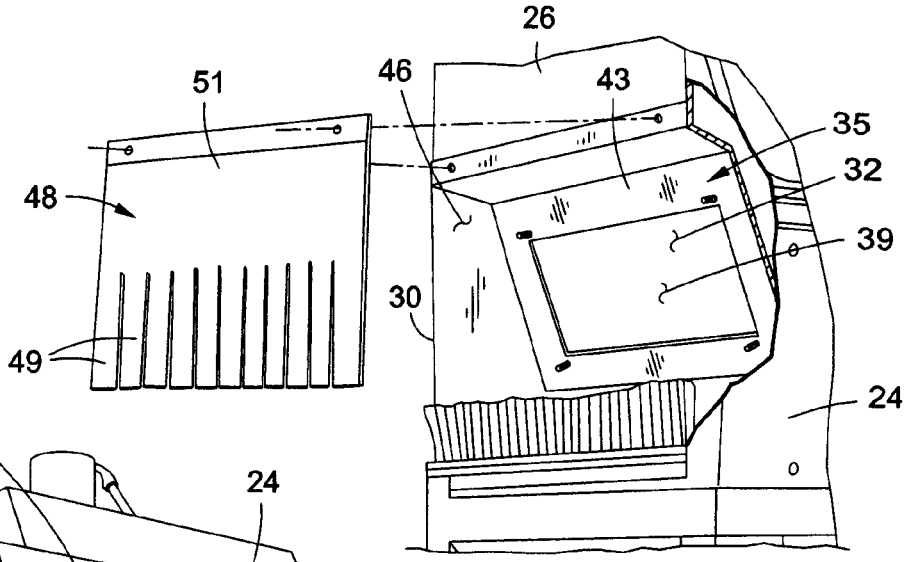
FIG. 1A is an exploded perspective view of a curtain and a portion of a carving cabinet housing including an attachment panel opening in communication with a carving cabinet enclosure.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Referring now to the drawings, wherein the showings are for purposes of illustrating a preferred embodiment of the present invention only, and are not for purposes of limiting the same, there is depicted a carving cabinet 10 (see FIG. 1) for carving, etching, engraving, sculpting (collectively referred to herein as "carving"), or otherwise imparting a design into a work-piece 12. The carving cabinet 10 is specifically configured and adapted to enable carving of the work-piece 12 (see FIG. 5) without requiring complete or substantial covering of the work-piece 12 with a conventional protective wrap. Rather, the carving cabinet 10 uniquely includes a guard or barrier member 14 including a carving port 18 (see FIGS. 3 and 4). During normal operation of the carving cabinet 10, the work-piece 12 is held against the barrier member 14, outside of the main carving enclosure, with the portion of the work-piece 12 that is to be carved held in alignment with the carving port 18. Thus, when carving particulate is directed toward the work-piece 12, the carving particulate passes through the carving port 18 and interfaces with only that portion of the work-piece 12 aligned with the carving port 18, with the remaining portion of the work-piece 12 remaining outside of the main carving enclosure and protected by the barrier member 14. By remaining outside of the main carving enclosure, the work-piece 12 is protected from inadvertent scratching or scuffing from abrasive moving about the main carving enclosure. Thus, the carving cabinet 10 allows for quicker and more efficient carving of the work-piece 12. In certain implementations, the carving cabinet 10 can reduce the processing time by approximately 40% relative to conventional carving techniques, which in turn, reduces the overall cost of carving the work-piece 12.

Figure 1:
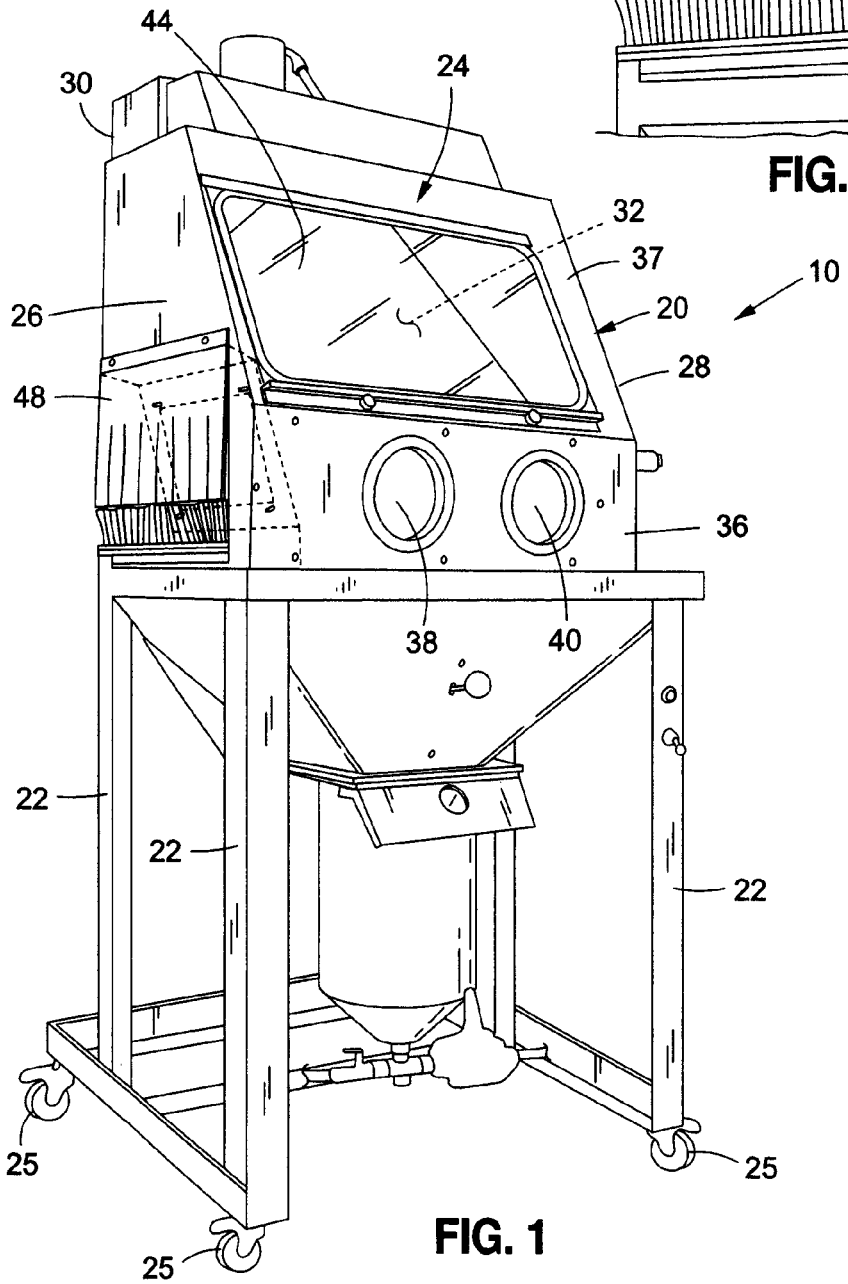
FIG. 1 is a perspective view of a carving cabinet constructed in accordance with an embodiment of the present invention.
Figure 6:
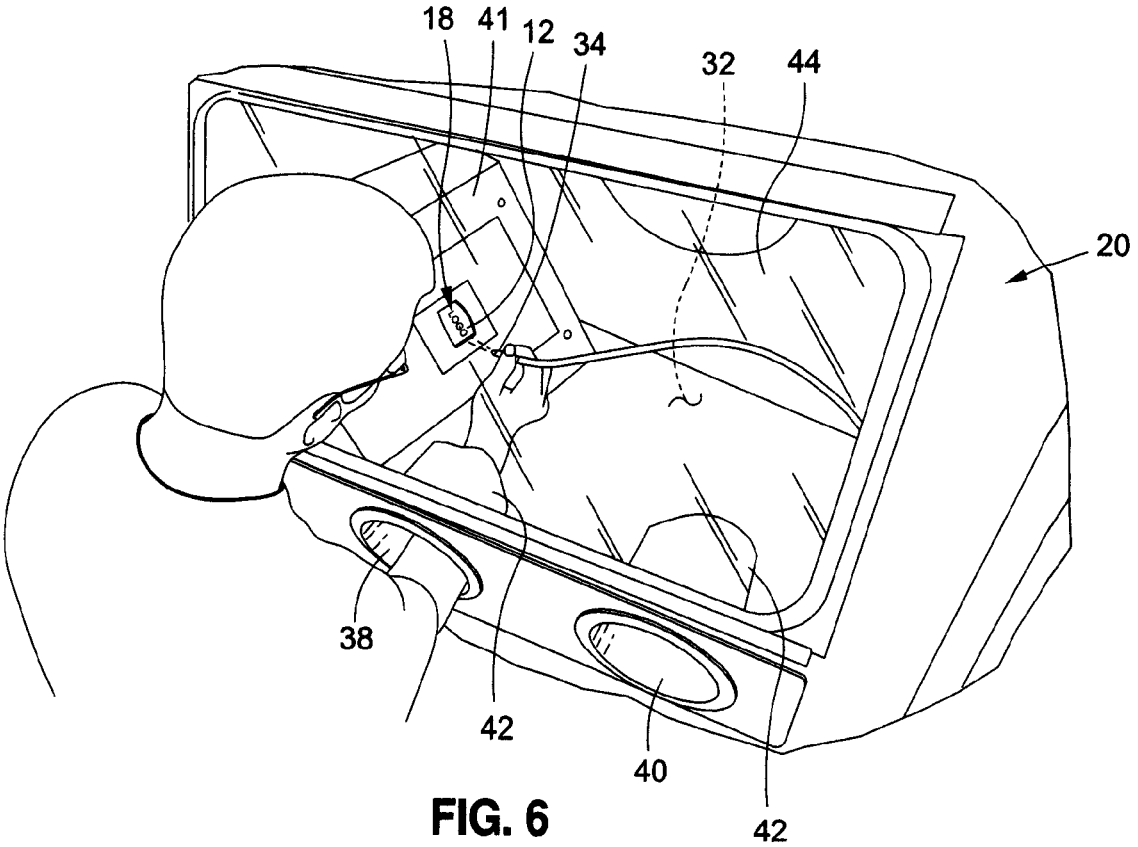
FIG. 6 is a perspective view of a user directing carving media toward the work-piece through the carving port formed in the barrier member.

Referring now specifically to FIG. 1, the exemplary embodiment of the carving cabinet 10 includes a housing 20 supported on a plurality of legs 22, which in turn, may be supported by casters or wheels 25 to enable movement of the cabinet 10. The housing 20 defines a generally trapezoidal configuration and includes a front wall 24, a pair of sidewalls 26, 28, and a rear wall 30, which collectively define a main carving enclosure 32 for operating a carving tool 34 (see FIG. 6) when carving the work-piece 12. According to one embodiment, the main carving enclosure 32 does not exceed 55 cubic feet, although other embodiments may include enclosures 32 greater than 55 cubic feet. The front wall 24 may include a substantially vertical lower section 36 and an inclined upper section 37 angularly offset from the vertical lower section 36. The vertical section 36 includes one or more work ports 38, 40 formed therein. According to one embodiment, the vertical section 36 is bolt-on and removable allowing different configuration of vertical section 36 to be supplied. The standard work ports 38, 40 allow a user to extend an arm into the main carving enclosure 32 for operating the carving tool 34 (see FIG. 6). Glove(s) and/or cuffs 42 (see FIG. 6) may be coupled to the front wall 24 adjacent respective ones of the work ports 38, 40 to protect the user's hands and arms during carving operations. It is understood that the gloves are optional, and thus, while the exemplary embodiment does not include gloves, it is understood that other embodiments include gloves.

Figure 1B:
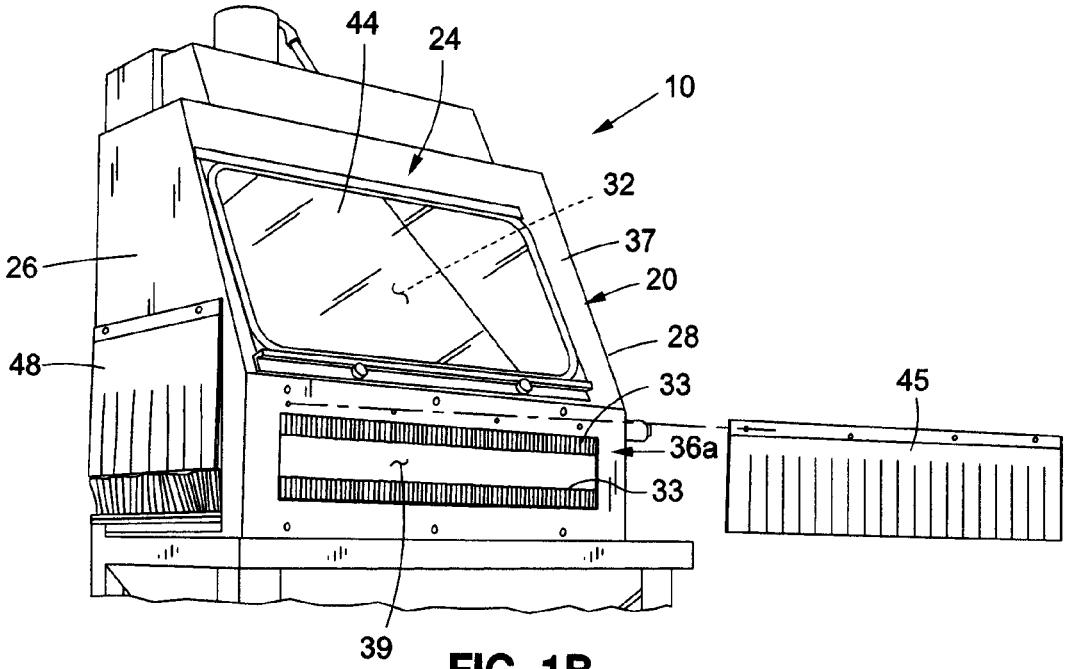
FIG. 1B is a partial exploded perspective view of another embodiment of the cabinet having a high velocity brushed part entrance port.
Figure 1C:
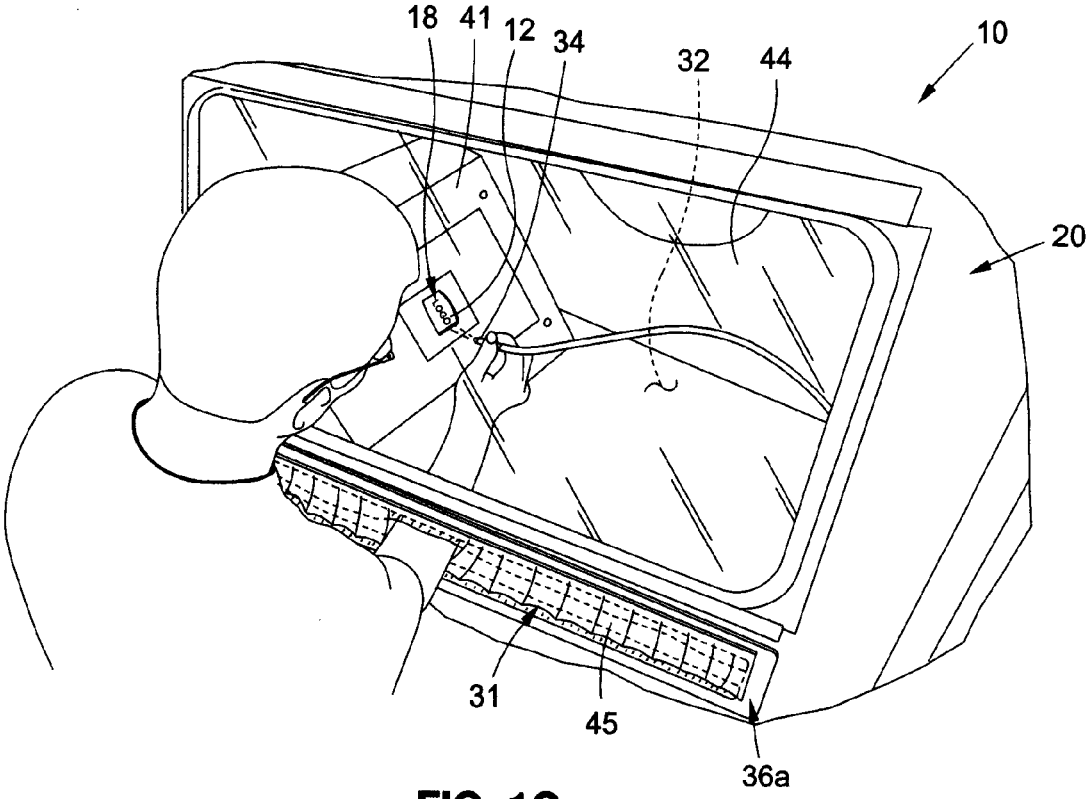
FIG. 1C is a partial upper perspective view of an operator using the cabinet depicted in FIG. 1B.

One variation of vertical section 36 is shown in FIGS. 1B and 1C. The cabinet 10 depicted in FIGS. 1B and 1C includes vertical section 36*a* which defines a high velocity brushed part entrance port 31 including two vertically mounted brushes 33, one top and one bottom, with a center wrist gap 39 between the two brushes 33 to allow the operator to insert and hold the part inside the cabinet 10 for standard part sandcarving. This variation of section 36*a* also includes an outside slit rubber curtain 45 that the negative cabinet pressure then pulls against the brushes 33 to seal all other areas of the operator work station not being used.

The inclined section 37 of the front wall 24 is angularly offset from the vertical section 36 and includes a window 44 for allowing a user to lean toward the enclosure 32 for viewing into the enclosure 32 during operation of the carving tool 34, as will be described in more detail below.

The carving cabinet housing 10 includes a work-piece vestibule 46 (see FIG. 1A) extending inwardly from at least one of the sidewalls toward the enclosure 32, because this vestibule is sealed from the inside carving cabinet 10 it is not considered as part of the inside cabinet area volume. This vestibule 46 area reduces the main inside volume area of cabinet 10 increasing the formula results for cabinet air changes per minute created by the dust collector exhaust blower and required by air pollution control agencies. The work-piece vestibule 46 is defined by the sidewall 26, the front wall 24, the rear wall 30 and an attachment panel 35, which includes an attachment panel opening 39 formed therein and in communication with the enclosure 32. In one embodiment, the attachment panel 35 is inclined and includes an inner face 41 (see FIG. 6) facing toward the enclosure 32 and an opposed outer face 43 (see FIGS. 1A and 2) facing away from the enclosure 32, wherein the attachment panel opening 39 extends between the inner and outer faces 41, 43. The inclination of the attachment panel 35 results in a work-piece vestibule 46 that is generally trapezoidal in shape, and which allows the operator to more easily view the work-piece 12 (through the carving port 18), during carving operations.

According to one embodiment, the work-piece vestibule 46 does not form part of the main carving enclosure 32 since the vestibule 46 is effectively sealed from the carving enclosure 32 when carving a work-piece 12. As such, the carving enclosure 32 will typically include a negative pressure/vacuum during operation of the carving cabinet 10 to collect abrasive within the main carving enclosure 32, while the vestibule 46 does not include a negative pressure, since it is separate from the carving enclosure 32. Along these lines, since the vestibule 46 is separate from the enclosure 32, when the volume of the carving enclosure 32 is calculated, the work-piece vestibule 46 is not included in that calculation. The volume of the carving enclosure 32 may be critical when applying for operating permits for the blasting machine, wherein a machine having a smaller carving enclosure 32 typically is easier to obtain permitting, if required. Thus, the ability to disregard the volume of the work-piece vestibule 46 when calculating the volume of the carving enclosure 32 provides significant advantages.

A curtain 48 (see FIGS. 1 and 1A) may be coupled to the sidewall 26 to cover the work-piece vestibule 46. Screws, rivets, nails, magnets, or other mechanical fasteners may be used to connect the curtain 48 to the sidewall 26. The curtain 48 may include a plurality of fingers 49 attached to a common base 51. In order to carve a work-piece 12, the work-piece 12 is passed through the curtain 48 and remains in the work-piece vestibule 46, which is separated from the enclosure 32 by the barrier member 14 (see FIGS. 2-3).

Figure 2:
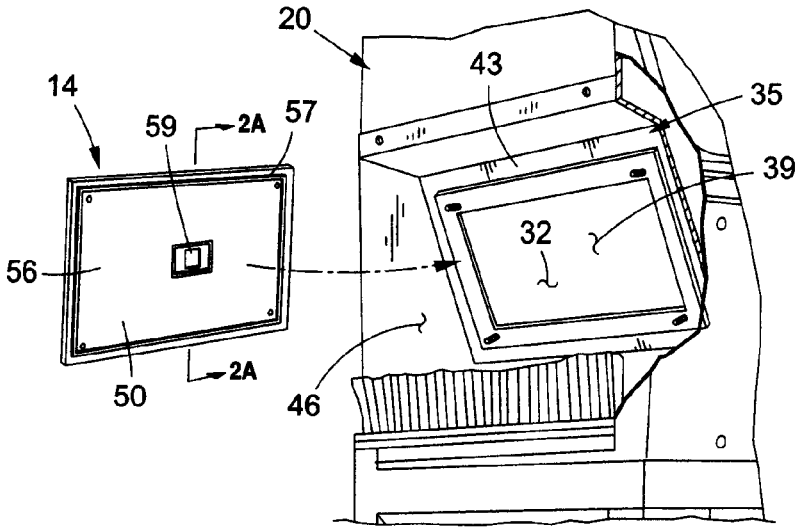
FIG. 2 is an exploded rear perspective view of a barrier member having a carving port formed therein, the barrier member being connectable to the attachment panel adjacent the attachment panel opening.
Figure 2A:
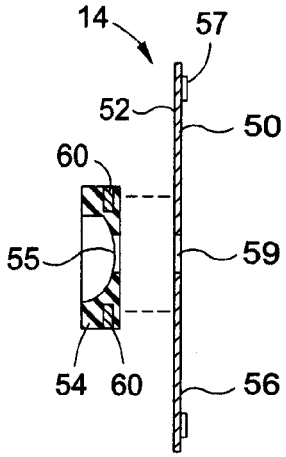
FIG. 2A is a side sectional view of the barrier member depicted in FIG. 2.
Figure 3:
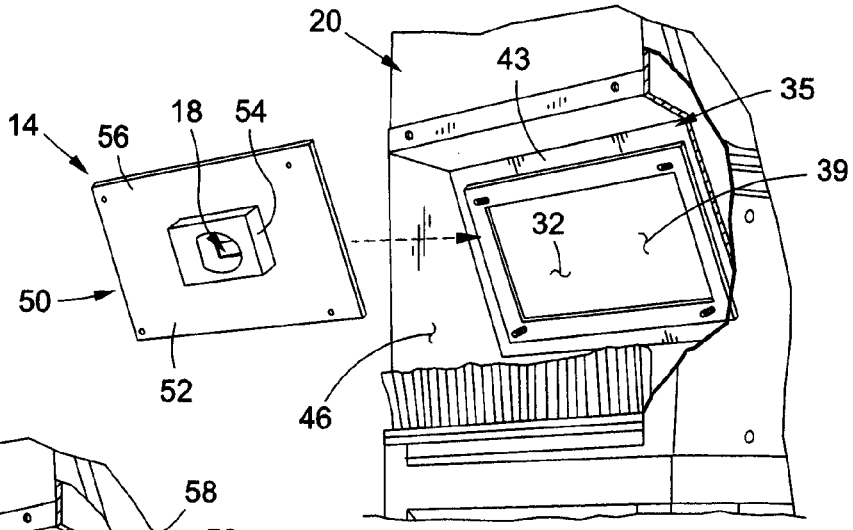
FIG. 3 is an exploded front perspective view of the barrier member and attachment panel depicted in FIG. 2.
Figure 4:
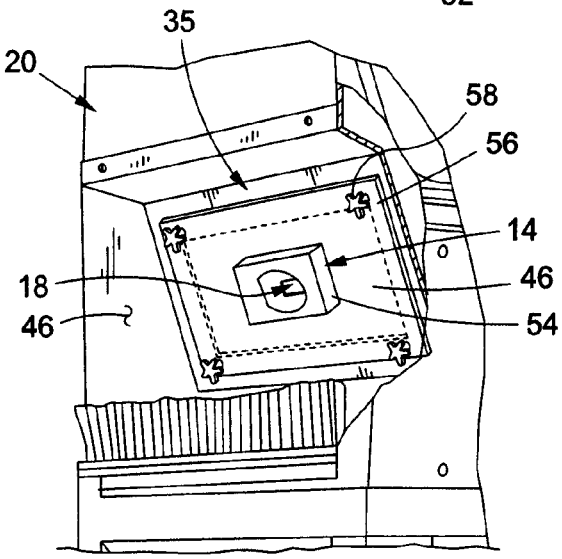
FIG. 4 is a perspective view of the barrier member coupled to the carving cabinet housing.

Referring now to FIGS. 2-4, there is depicted one embodiment of the barrier member 14, which is specifically configured and adapted to be selectively connectable to the housing 20 and to substantially separate the work-piece vestibule 46 from the enclosure 32. In this respect, the barrier member 14 also separates the work-piece 12 (see FIG. 5) itself from the enclosure 32 when carving the work-piece 12, as will be described in more detail below.

According to one embodiment, the barrier member 14 includes a first internal surface 50 facing toward the enclosure 32, and an opposing second external surface 52 facing away from the enclosure 32 when the barrier member 14 is attached to the housing 20. The carving port 18 extends between the first surface 50 and the second surface 52. During carving of the work-piece 12, the work-piece 12 is held in alignment with the carving port 18 adjacent the second surface 52 to enable carving of the work-piece 12 through the carving port 18.

The barrier member 14 may be available in several different embodiments, which may be varied depending on the work-piece 12 and/or the carving that is to be done. In the embodiment depicted in FIGS. 2-4, the barrier member 14 includes a molded body 54 having a recess corresponding to the shape of the work-piece 12 and a mold processing port 55 formed within the recess to enable passage of the carving particulate therethrough. In the particular molded body 54 shown in FIGS. 2-4, the molded body 54 defines a recess that is complimentary to the shape of a wine glass to enable carving of the wine glass. The molded body 54 may be formed of pourable urethane, polyurethane, silicon, or other materials known in the art.

The molded body 54 is coupled to a mounting plate 56, which is configured and adapted to be connected to the attachment panel 35 and extend over the attachment panel opening 39. The mounting plate 56 includes a plate processing port 59 extending between opposed external surfaces of the mounting plate 56. When the molded body 54 is attached to the mounting plate 56, the mold processing port 55 is aligned with the plate processing port 59 to collectively define the carving port 18.

According to one embodiment, the molded body 54 includes one or more magnets 60 encapsulated therein for purposes of effectuating tool-less detachable engagement between the molded body 54 and the mounting plate 56. The magnets 60 are preferably rare earth magnets which create a strong magnet attraction between the molded body 54 and the mounting plate 56 so as to create a substantially fluid-tight seal between the molded body 54 and the mounting plate 56. As noted above, when the molded body 54 is attached to the mounting plate 56, the mold processing port 55 is aligned with the plate processing port 59. The plate processing port 59 may be positioned at the approximate center of the mounting plate 56, or alternatively, at a location offset from the approximate center. An offset location may be desirable to enable the carving port 18 to be moved relative to the enclosure 32 simply by rotating the mounting plate 56 before the mounting plate 56 is attached to the attachment panel 35. The detachability of the molded body 54 from the mounting plate 56 allows several different molded bodies, each having a unique molded configuration, to be used and quickly interchanged with a single mounting plate 56. In this respect, various molded bodies may be used to carve designs into several different work-pieces, such as wine glasses, beer mugs, trophies, plaques, etc.

Although the exemplary embodiment utilizes magnets 60 for connecting the molded body 54 to the mounting plate 58, it is understood that other mechanical fasteners known in the art may also be used, such as brackets, snaps, adhesives, bolts, screws, etc.

One or more engagement members 58 (see FIG. 4) are employed for detachably connecting the mounting plate 56 to the attachment panel 35. The engagement member 58 includes a threaded post extending from the attachment panel 35, which is advanced through a corresponding aperture formed in the mounting plate 56 and threadably engages with a nut. Other engagement members 58 known in the art, such as magnets, clasps, etc., may also be used. A gasket or seal 57 may be positioned between the mounting plate 56 and attachment panel 35 to create a substantially fluid tight seal therebetween when the mounting plate 56 is connected to the attachment panel 35.

Figure 5:
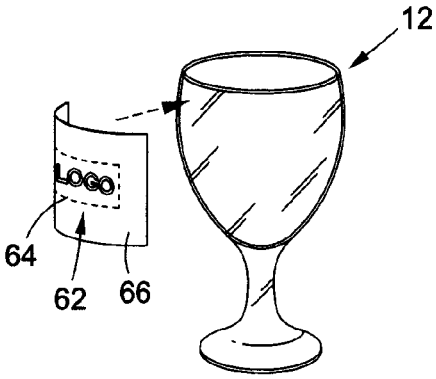
FIG. 5 is a perspective view of a stencil attachable to a work-piece.

With the basic structural features of the carving cabinet 10 described above, the following will focus on operation of the carving cabinet 10 for carving a work-piece 12 according to one embodiment. Referring now to FIG. 5, before the work-piece 12 is carved, a stencil or film 62 is applied to the work-piece 12, wherein the film 62 includes a desired logo, pattern, or other design incorporated therein. The film 62 includes a central portion 64, which includes the desired logo, and a peripheral portion 66 extending radially outward from the central portion 64. The film 62 may have an adhesive backing to allow the film 62 to be pressed against the work-piece 12 in the desired location to temporarily adhere the film 62 to the work-piece 12 during the carving process.

After the film 62 is applied to the work-piece 12, the work-piece 12 is ready for carving. Due to the unique configuration of the carving cabinet 10 (see FIG. 1), the work-piece 12 does not require additional protective wrap to be applied, as is typically required when using conventional carving cabinets.

The user then passes the work-piece 12 through the curtain 48 (see FIGS. 1 and 1A) to place the work-piece 12 within the vestibule 46. As noted above, the vestibule 46 is separate from the main carving enclosure 32, with the vestibule 46 being easily accessed without having to open a door. The work-piece 12 is nested within the molded body 54 (see FIG. 3), with the central portion 62 (see FIG. 5) of the film 62 being aligned with the carving port 18 (see FIG. 3). The molded body 54 and the film 62 are cooperatively configured such that when the work-piece 12 is properly nested within the molded body 54, the peripheral portion 66 (see FIG. 5) of the film 62 extends radially outward, beyond the carving port 18 to ensure that no portion of the work-piece 12 is exposed to the carving port 18, except for that portion of the work-piece 12 residing under the logo or design formed in the central portion 64.

Using one-hand, the user holds the work-piece 12 against the molded body 54 (see FIG. 4), with the logo/design aligned with the carving port 18. The user's remaining hand extends through a work port 38 (see FIG. 6) and operates the carving tool 34 to direct high-pressure carving abrasive toward the work-piece 12. For a right-handed operator, the work-piece 12 will typically be held using the operator's left hand, while the operator's right hand will extend through the left-most work port 38. The system may be reversed, mirror image construction, for left-handed operators, e.g., the work-piece is held in the operator's right hand and the operator's left-hand extends through a right-most work port 40 for manipulating the carving tool 34.

The trapezoidal configurations of the housing 20 (see FIG. 1) and the vestibule 46 (see FIG. 1A) allows the operator to easily view the work-piece 12 when it is aligned with the carving port 18. In particular, the angled viewing window 44 (see FIG. 6) allows the operator to stand and lean forward to see the carving port 18 and the inclined surface 41 of the vestibule 41. Along these lines, the viewing window 44 may be offset toward the vestibule 46 to facilitate viewing of the work-piece through the carving port 18.

The carving abrasive passes through the carving port 18 to impact the work-piece 12. The carving abrasive bounces off the work-piece 12 and remains in the enclosure 32, along with flakes, slivers, or chips which are carved off the work-piece 12. In this respect, when the work-piece 12 is nested within the molded body 54 (see FIG. 4), the work-piece 12 effectively seals against the molded body 54 so as to prevent the carving abrasive from leaving the enclosure 32. Therefore, the remaining portion of the work-piece 12 is protected from inadvertent scratching, scuffing, etc. by the carving media or other particulate.

If the carving pattern extends circumferentially around the work-piece 12, the user may rotate the work-piece 12 to complete the circumferential design. In other words, the operator may slightly remove the work-piece 12 away from the carving port 18, rotate the work-piece 18, and then move the work-piece 12 back toward the carving port 18 to seal the work-piece 12 against the barrier member 14 for continued carving.

The carving cabinet 10 may include a filtration system for collecting the carving media and particulate and separating the carving media from the remaining particulate to allow for recycling of the carving media during subsequent carving processes. For more information regarding filtration and separating systems, please refer to U.S. Pat. No. 7,008,304, entitled Abrasive and Dust Separator, owned by Media Blast & Abrasives, Inc., the owner of the present application, and the contents of which are expressly incorporated herein by reference.

Figure 7:
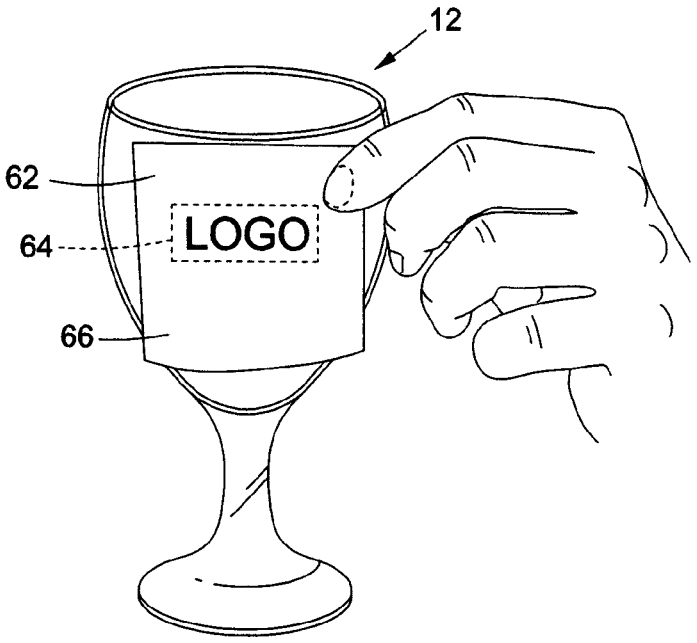
FIG. 7 is a front view of the stencil being removed from the work-piece.

After the work-piece 12 has been carved, the carving tool 34 is turned off and the work-piece 12 is removed from the vestibule 46. The film 62 is then removed from the work-piece 12 to expose the carved design (see FIG. 7). Once the film 62 has been removed, the work-piece 12 is ready to ship to the customer. In this respect, since the work-piece 12 does not require protective wrapping or tape during the carving process, the time required to process the work-piece 12 into condition for shipping is minimal, and in some instances, the total processing time is 40% less than conventional processing times.

Figure 8:
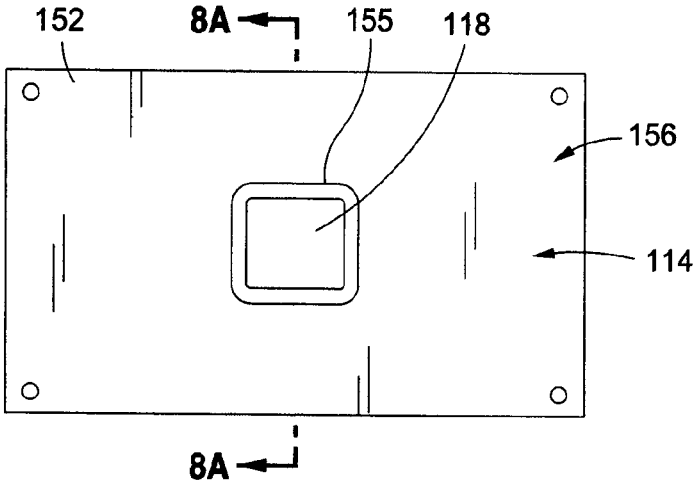
FIG. 8 is a plan view of another embodiment of a barrier member coupled to the carving cabinet housing, wherein the barrier is specifically configured and adapted for carving substantially flat or planar surfaces.
Figure 8A:
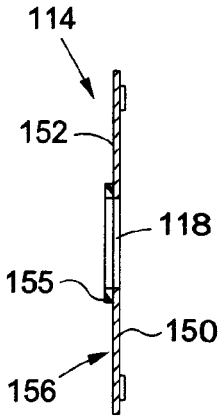
FIG. 8A is a side sectional view of the barrier member depicted in FIG. 8.

The foregoing describes a barrier member 14 which includes a molded body specifically configured and adapted for use with a particular work-piece 12. However, other barrier members may also be used with the carving cabinet housing 20 (see FIG. 2-4) for carving other work-pieces 12. For instance, FIG. 8 shows a barrier member 114 specifically configured and adapted for carving a generally planar surface of a work-piece 12, such as a generally flat work-piece, e.g., a sheet of glass. In this respect, the barrier member 114 includes a mounting plate 156 having a first interior surface 150, an opposing second exterior surface 152, and an aperture formed therein and extending between the first and second surfaces to define a carving port 118. A protective gasket 155 is coupled to the mounting plate 156 adjacent the carving port 118 to protect a work-piece 12 (see FIG. 5) disposed adjacent the carving port 118 and to prevent carving media and other particulate from escaping from the enclosure 32. In this respect, the protective gasket 155 may form a substantially fluid-tight seal with the work-piece 12 when the work-piece is held against the gasket 155. According to one embodiment, the protective gasket 155 completely circumnavigates the carving port 118, although it is understood that in other embodiments, the protective gasket 155 may only partially circumscribe the carving port 118. The barrier member 114 is detachably connectable to the carving cabinet housing 20 in a manner similar to the barrier member 14 described above.

According to one embodiment, the barrier member 114 is configured to allow for size adjustment of the carving port 118 to accommodate work-pieces that vary in size, as well as logos/designs that vary in size. For instance, if the logo/design is small, a large carving port 118 is not required. Conversely, if the logo/design is large, a large carving part 118 may be needed or useful. To that end, the barrier member 114 may include one or more adjustment panels (not shown) which may be selectively transitioned between stowed and deployed positions to vary the size of the carving port 118. As the adjustment panel(s) move from the stowed position to the deployed position, the size of the carving port 118 decreases, and as the adjustment panel(s) move from the deployed position to the stowed position, the size of the carving port 118. The adjustment panel(s) may transition between the stowed and deployed positions by translating therebetween, or moving in radially expanding and contracting directions. The adjustment panel(s) may be coupled to the mounting plate 156 adjacent the first or second surfaces 150, 152, or alternatively, the adjustment panel(s) may extend within an internal pocket formed within the mounting plate 156 between the first and second surfaces 150, 152.

Figure 9:
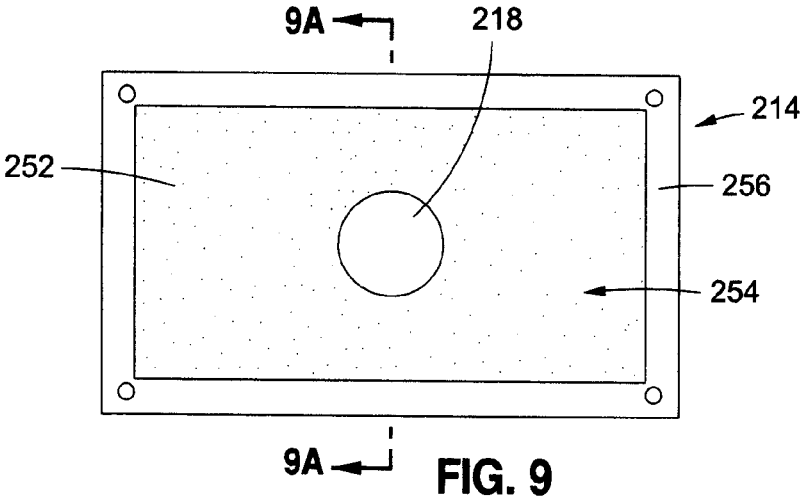
FIG. 9 is a plan view of a further embodiment of a barrier member coupled to the carving cabinet housing, the barrier member including a portion formed from a resilient material.
Figure 9A:
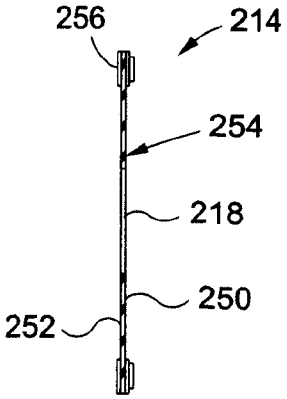
FIG. 9A is a side sectional view of the barrier member depicted in FIG. 9.

Referring now to FIG. 9, there is depicted yet another embodiment of a barrier member 214, which includes a flexible, resilient portion capable of conforming to the shape of the work-piece 12. In particular, the barrier member 214 includes a mounting plate or frame 256 and a resilient panel 254 connected to the frame 256. The resilient panel 254 includes a first interior surface 250, an opposing second exterior surface 252, and a carving port 218 extending between the first and second surfaces 250, 252. The mounting frame 254 circumnavigates the carving port 218.

According to one embodiment, the resilient panel 254 is formed from a flexible material, such as rubber or the like. The resilient panel 254 is configured to be disposable in tension when the work-piece 12 (see FIG. 5) is disposed adjacent the second exterior surface 252 thereof. The barrier member 214 may be configured to effectively form a seal with the work-piece 12 when the work-piece 12 is disposed adjacent the second surface 252 of the barrier member 254 so as to maintain carving media and other particulates within the enclosure 32 (see FIG. 1).

The resilient panel 254 allows work-pieces 12 of different sizes, shapes, and configuration to be carved. In this respect, the resilient panel 254 is adaptable to the particular configuration of the work-piece 12.

Figure 10:
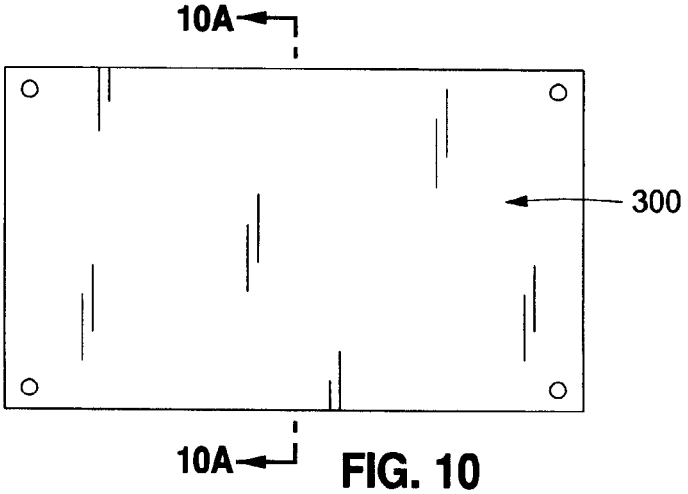
FIG. 10 is a plan view of a block-off plate coupled to the carving cabinet housing and covering the attachment panel opening.
Figure 10A:
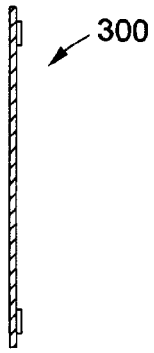
FIG. 10A is a side sectional view of the block-off plate depicted in FIG. 10.

Referring now to FIG. 10, there is shown a block-off plate 300 which may be attached to the attachment panel 35 (see FIG. 2) to cover the attachment panel opening 39. When the block-off plate 300 is connected to the attachment panel 35, the carving cabinet 10 (see FIG. 1) may function similar to a conventional carving cabinet wherein the work-piece 12 is positioned within the enclosure 32 for carving. In this respect, the side wall opposing the block-off plate 300 may include an access door to enable placement of the work-piece 12 within the enclosure 32. The block-off plate 300 may be selectively attachable to the carving cabinet 10, as desired by the user.

In this respect, the user may selectively employ any one of the barrier members 14, 114, 214 or the block-off plate 300, depending on the work-piece 12 and the desired carving.

It is understood that the particular embodiments shown in the attached drawings and described herein are exemplary in nature only, and do not limit the scope of the present invention. For instance, the size and shape of the mounting plates and carving ports may be varied, and may define quadrangular, circular, oval, trapezoidal or other shapes known in the art.

Additional modifications and improvements of the present invention may also be apparent to those of ordinary skill in the art. Thus, the particular combination of components and steps described and illustrated herein is intended to represent only certain embodiments of the present invention, and is not intended to serve as limitations of alternative devices and methods within the spirit and scope of the invention.

What is claimed is:

1. An abrasive blasting cabinet for carving a work-piece with an abrasive blasting tool, the abrasive blasting cabinet comprising:

a housing having:

a front wall;

a rear wall in opposed relation to the front wall;

a pair of sidewalls extending between the front wall and the rear wall;

an attachment panel extending between the front wall and the rear wall and being located between the pair of sidewalls, the attachment panel having an opening formed therein;

the housing defining an enclosure for operating the abrasive blasting tool when carving the work-piece, and a vestibule being sized and configured to at least partially receive the workpiece, the vestibule being at least partially defined by the front wall, the rear wall and the attachment panel, the enclosure and the vestibule being at least partially separated by the attachment panel; and a barrier member attachable to the attachment panel so as to substantially extend across the opening in the attachment panel, the barrier member including:

a first surface facing toward the enclosure;

an opposing second surface facing away from the enclosure; and a carving port extending between the first surface and the second surface;

the barrier member being configured to allow the work-piece to be disposable adjacent the second surface such that the work-piece does not extend through the carving port, and a portion of the work-piece extends across the carving port to enable carving of that portion of the work-piece extending across the carving port through the interaction of the carving tool on the work-piece through abrasive blasting port.

2. The abrasive blasting cabinet recited in claim 1, further comprising a viewing window coupled to the housing to enable viewing into the enclosure.

3. The abrasive blasting cabinet recited in claim 1, further comprising a working port formed in the housing and configured enable a user to reach into the enclosure.

4. The abrasive blasting cabinet recited in claim 3, wherein the working port is formed in a panel configured to be detachably connected to the housing.

5. The abrasive blasting cabinet recited in claim 1, wherein the barrier member is detachably coupled to the housing.

6. The abrasive blasting cabinet recited in claim 1, wherein at least a portion of the barrier member is formed from a flexible material.

7. The abrasive blasting cabinet recited in claim 6, wherein at least a portion of the barrier member is formed from a rubber material.

8. The abrasive blasting cabinet recited in claim 1, wherein at least a portion of the barrier member is configured to be disposable in tension when the work-piece is disposed adjacent the second surface.

9. The abrasive blasting cabinet recited in claim 8, wherein the barrier member is configured to form a seal with the work-piece when the work-piece is disposed adjacent the second surface of the barrier member.

10. The abrasive blasting cabinet recited in claim 1, wherein the barrier member includes a molded portion sized and configured to be complimentary to the work-piece.

11. The abrasive blasting cabinet recited in claim 10, wherein the barrier member is formed of urethane.

12. The abrasive blasting cabinet recited in claim 1, wherein the barrier member is formed from a rigid material.

13. The abrasive blasting cabinet recited in claim 12, wherein the barrier member is formed from a metal material.

14. The abrasive blasting cabinet recited in claim 1, further comprising a curtain coupled to the housing and at least partially extending over the barrier member.

15. The abrasive blasting cabinet recited in claim 1, wherein the barrier member is configured such that entirety of the work-piece remains outside the enclosure defined by the housing while the abrasive blasting tool interacts with the work-piece.

16. The abrasive blasting cabinet recited in claim 1, the vestibule being sized and configured to receive the entire work-piece for carving of the work-piece.

17. A method of carving a work-piece, the method comprising the steps of:

placing a work-piece adjacent an abrasive blasting cabinet for carving the work-piece with an abrasive blasting tool, the abrasive blasting comprising:

a housing having:

a front wall;

a rear wall in opposed relation to the front wall;

a pair of sidewalls extending between the front wall and the rear wall;

an attachment panel extending between the front wall and the rear wall and being located between the pair of sidewalls, the attachment panel having an opening formed therein;

the housing defining an enclosure for operating the abrasive blasting tool when carving the work-piece, and a vestibule being sized and configured to at least partially receive the workpiece, the vestibule being at least partially defined by the front wall, the rear wall and the attachment panel, the enclosure and the vestibule being at least partially separated by the attachment panel; and a barrier member attachable to the attachment panel so as to substantially extend across the opening in the attachment panel, the barrier member including:

a first surface facing toward the enclosure;

an opposing second surface facing away from the enclosure; and a carving port extending between the first surface and the second surface;

the work-piece being placed adjacent the second surface; and directing abrasive blasting media from the abrasive blasting tool to the work-piece through the carving port.

18. The method recited in claim 17, wherein the work-piece is placed adjacent the second surface such that no portion of the work-piece extends completely through the carving port and into the enclosure.

19. The method recited in claim 17, wherein the entirety of the work-piece remains outside of the enclosure during the directing step.

* * * * *